United States Patent [19]

Bach et al.

[11] Patent Number: 4,778,309

[45] Date of Patent: Oct. 18, 1988

[54] STACKABLE GRID MATERIAL FOR SOIL CONFINEMENT

[75] Inventors: Gary Bach; Timothy Kettner, both of Appleton, Wis.

[73] Assignee: Presto Products, Incorporated, Appleton, Wis.

[21] Appl. No.: 32,278

[22] Filed: Mar. 30, 1987

[51] Int. Cl.[4] ..... E02D 29/00

[52] U.S. Cl. ..... 405/258; 405/284

[58] Field of Search ..... 405/16, 15, 19, 258, 405/272, 284, 286

[56] References Cited

U.S. PATENT DOCUMENTS

| | | | |
|---|---|---|---|
| 1,905,176 | 4/1933 | Kieckhefer | 405/15 X |
| 3,269,125 | 8/1966 | Moore | 405/286 X |
| 3,561,219 | 2/1971 | Nishizawa et al. | 405/19 |
| 4,530,622 | 7/1985 | Mercer | 405/258 |
| 4,619,560 | 10/1986 | Crinnion et al. | 405/284 |

OTHER PUBLICATIONS

Reinforced Earth®, Technical brochure, 16 pages (1982).

Geoweb TM Technical brochure, 14 pages (1964).

*Primary Examiner*—David H. Corbin

*Attorney, Agent, or Firm*—Willian Brinks Olds Hofer Gilson & Lione Ltd.

[57] ABSTRACT

A stackable grid material for soil confinement is disclosed. The grid material comprises repeating pattern of cell structures with thin cell walls in between cells and open cell tops and bottoms. The cell wall material of the grid is notched such that the top edges of the cell wall material on the perimeter of a lower layer of grid material overlaps with the bottom edges of cell wall material on the perimeter of an upper layer of grid material. The internal cell walls are able to rest on top one another in spite of the overlap at the perimeter walls due to the positioning and shape of the notches.

19 Claims, 2 Drawing Sheets

FIG. 1
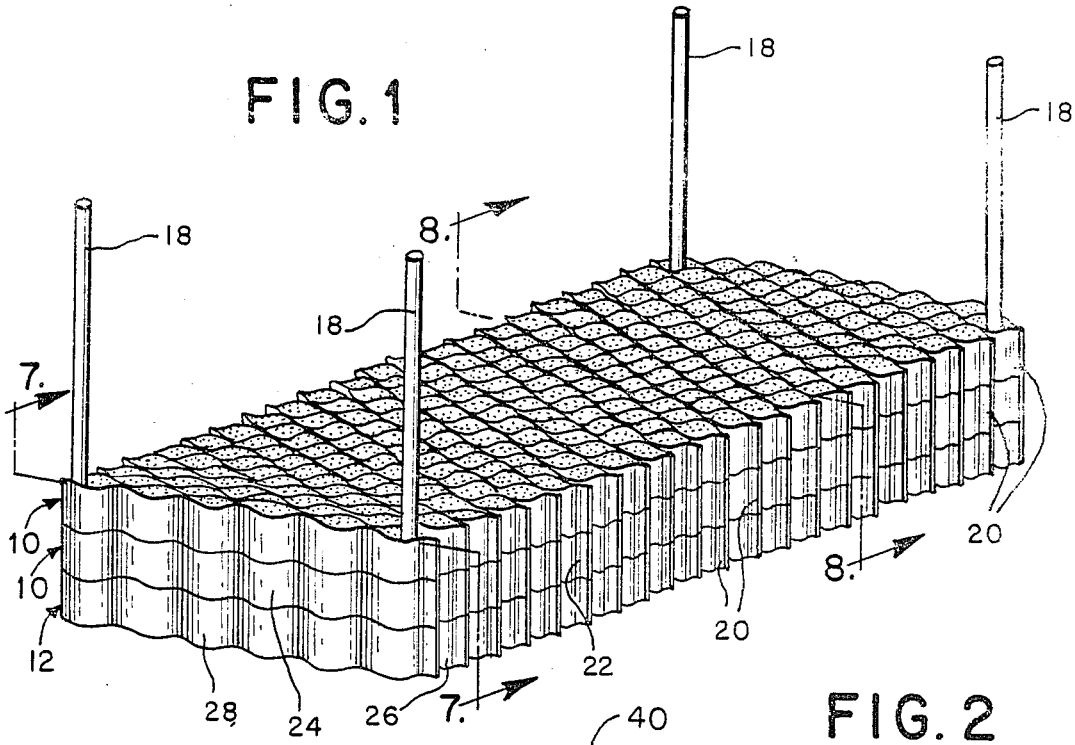
FIG. 2
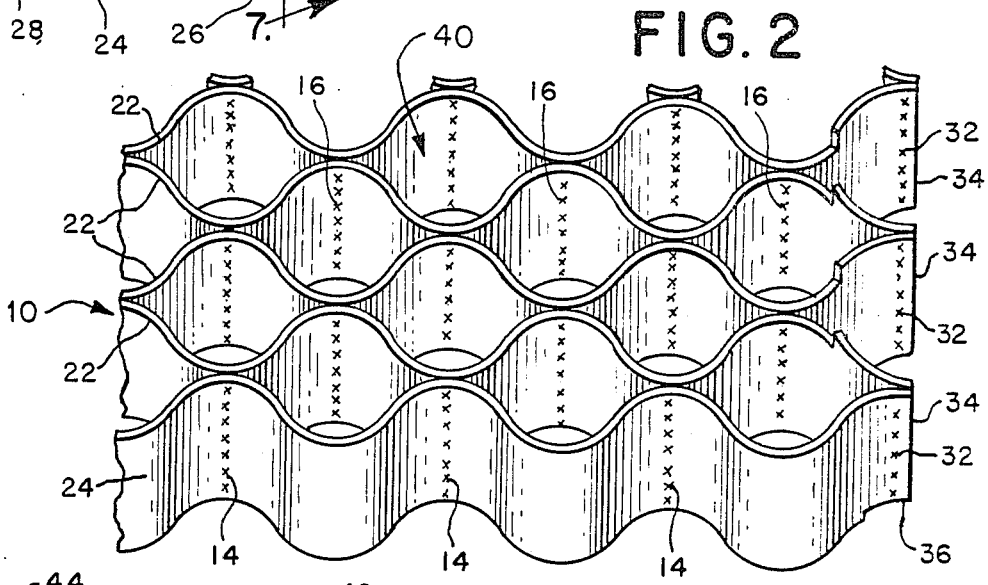
FIG. 9
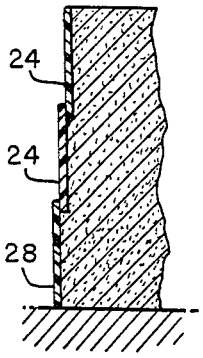
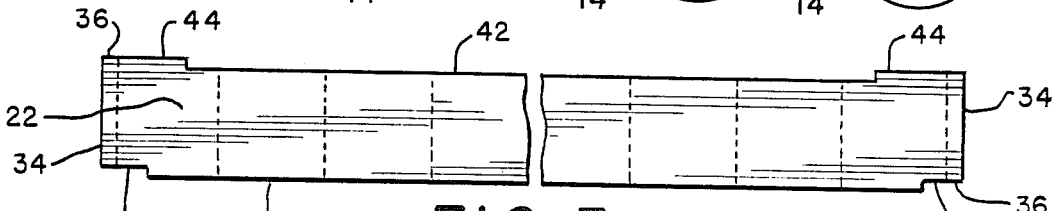
FIG. 3
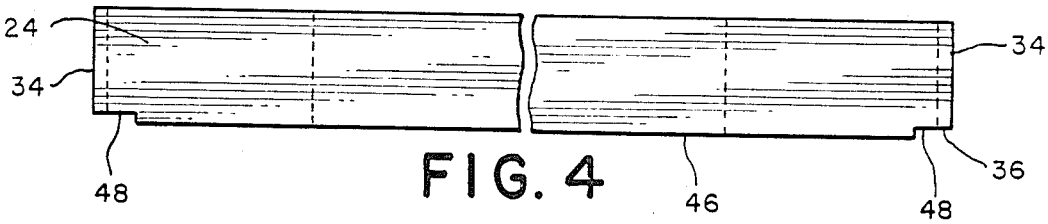
FIG. 4

STACKABLE GRID MATERIAL FOR SOIL CONFINEMENT

BACKGROUND OF THE INVENTION

The present invention relates to a stackable, soil confinement grid material. Specifically the present invention relates to a grid material which can be stacked up and filled with soil to create free standing walls and similar structures.

A grid section of cells used for soil confinement to provide a road base made from soils (sand, rounded rock, poorly graded aggregate, concrete, and the like) has been known and used for some time. A prime example is Geoweb TM plastic grid soil confinement system, sold by Presto Products, Incorporated, P.0. Box 2399, Appleton, Wis. 54913. Geoweb TM grid cells are made from plastic strips which are joined on their faces in a side by side relationship at alternating spacings so that when the strips are stretched out in a direction perpendicular to the faces of the strips, the resulting grid section is honeycomb-like in appearance, with sinusoidal or undulent shapped cells.

Voluminous reports have praised the ability of Geoweb TM grid cell material to support roadways. Geoweb TM grid cells have also been used in applications where one grid layer is stacked on another, such as a stepped back design for hill slope retention. Even free standing walls have been built with Geoweb TM grid cells. However, because the cells are open on top and bottom, there is a tendency for fill material to leak out of the cells if the cell below is not properly positioned. Also, the exposed soil in a cell not adequately covered is subject to being blown away by the wind.

In an effort to overcome these problems, free standing structures have been built with alternating layers of grid confinement cells and sheet material, such as water permeable fabric. While this approach has helped to cover the exposed open tops and bottoms of the cells, it has not been completely successful, and, more importantly, requires the additional use of the separate sheet material.

SUMMARY OF THE INVENTION

The present invention provides a stackable grid material for soil confinement having repeating patterns of cell structures with thin cell walls in between cells and open cell tops and bottoms. The cell wall material is notched such that the top edges of the cell wall material on the perimeter of a lower layer of grid material overlaps with the bottom edges of cell wall material on the perimeter of an upper layer of grid material. The internal cell walls are able to rest on top one another in spite of the overlap at the perimeter walls due to the positioning and shape of the notches.

The stackable grid material of the present invention provides a single material which can be used in repeated layers without the need for intermediate sheet material, and significantly reduces exposure to or leakage from material in the perimeter cells. The structure of the grid material makes it simple to build a wall or other free standing structure made of grid soil confinement cells and without exposed tops and bottoms of cells on the perimeter faces of the structure. Other advantages of the invention, as well as details of the preferred embodiment, will best be understood in view of the drawings, a brief description of which follows.

BRIEF DESCRIPTION 0F THE DRAWINGS

FIG. 1 is a perspective view depicting the construction of a wall using grid material of the present invention.

FIG. 2 is an enlarged perspective view of a corner portion of a grid layer like the layers used in the wall shown in FIG. 1 before it is filled with soil FIG. 3 is a plan view of one of the inside strips of the grid material used on upper layers of the wall of FIG. 1.

FIG. 4 is a plan view of one of the outside strips of the grid material used on upper layers of the wall of FIG. 1.

FIG. 9 is a sectional view taken along line 9—9 of FIG. 7.

DETAILED DESCRIPTION OF THE DRAWINGS AND PREFERRED EMBODIMENT OF THE INVENTION

Figure 5:
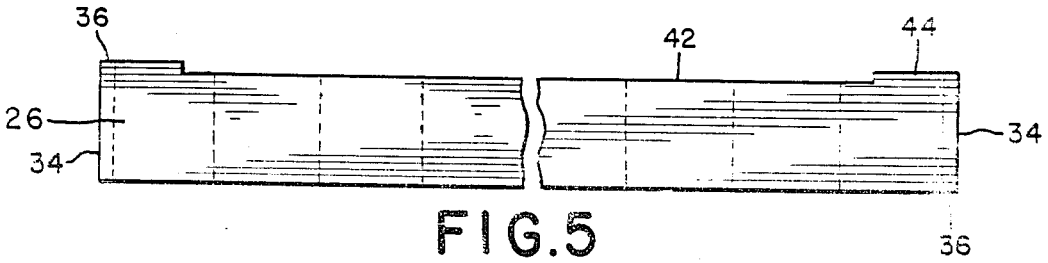
FIG. 5 is a plan view of one of the inside strips of the grid material used on the lowermost layer of the wall of FIG. 1.

FIG. 1 depicts a wall being constructed with stackable soil confinement grid material 10 of the preferred embodiment of the present invention. The grid material 10 is comprised of a plurality of strips of plastic 20 which are bonded together, one strip to the next, at alternating and equally spaced bonding areas.

In the preferred embodiment of the present invention, shown in more detail in FIG. 2, each layer of grid material 10 is made of an even number of uniformly wide plastic strips 20 in side by side relationship, bonded by ultrasonic welding. The preferred inside strips 22 differ in heir notched pattern from the outside strips 24, as more fully described hereafter. The bonding between strips may best be described by thinking of the strips as being paired, starting with an outside strip 24 paired to an outermost inside strip 22, a pair of the next two inside strips 22, etc. Each such pair is bonded at a bonding area constituting an outside weld 32 adjacent the end 34 of each strip 20. A short tail 36 between the end 34 of the strip 20 and the outside weld 32 is provided to stabilize segments of the strip 20 adjacent the outside weld 32. Each pair of strips is welded together at additional bonding areas 14, creating equal length strip segments between the outside welds 32.

In addition to these welds, one strip 20 from each adjacent pair of strips is also welded together at positions intermediate each of the welds in the pairs of strips, referred to hereafter as non-pair bonding areas 16. As a result, when the plurality of strips 20 are stretched in a direction perpendicular to the faces of the strips, the plastic strips bend in a sinusoidal manner and forms a grid of cells 40 in a repeating cell pattern.

Each cell 40 has two cell walls made from one strip 20 and two cell walls made from a different strip 20.

In this configuration, it is seen that the end section of each strip 20 forms one wall of a cell on the perimeter of the grid material 10. In addition, the outside strips 24 form cell walls all lying on the perimeter of the grid material. When several layers of grid materials 10 are stacked on top of one another, it is the open tops and bottoms of these perimeter cells which are exposed if each cell above and below is not directly aligned.

In the preferred embodiment of the present invention, the lowermost or base grid material 12 of a stack is designed to rest on a flat surface. (FIG. 1.) Since it has no grid layer 10 below it with which it needs to align, the bottom structure of each strip 20 in the base layer 12 is uniformly even. However, in many instances a grid layer 10 with notched bottom corners would be suitable as the bottom layer of a stack. In the preferred embodiment the inside strips 26 and outside strips 28 of a special base layer 12 differ from one another just as the inside strips 22 and outside strips 24 differ from one another. FIGS. 3–6 respectively are plan views of the inside and outside strips 22, 24, 26 and 28, showing the preferred shapes of these strips.

The inside strip 22 (FIG. 3) used for most grid layers has a central section 42 which is notched inwardly such that it is a predetermined distance below the upstanding edge section 44 adjacent the ends 34 of the strip 22. The central notched section 42 extends just beyond the region of the outermost non-pair bonding area 16.

Figure 6:
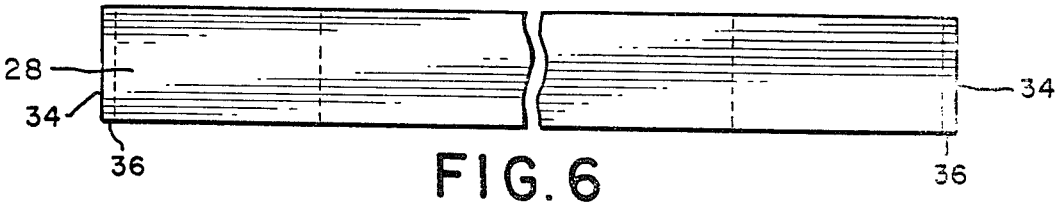
FIG. 6 is a plan view of one of the outside strips of the grid material used on the lowermost layer of the wall of FIG. 1.

In the preferred embodiment, the bonding areas 14 are about 13 inches apart on each strip, as are the non-pair bonding areas 16. Since the non-pair bonding areas 16 are intermediate the building areas 14, each cell wall comprises a section of the plastic strip about 6½ inches in length, between the alternating bonding areas 14 and non-pair bonding areas 16. The tail 36 is about 1 inch in length. The central notched section begins about 5½ inches from one outside weld 32 of the strip 22 and runs to a point about 5½ inches from the other outside weld 32. Since the outermost non-pair bonding area 16 is about 6½ inches from the outside weld 32, this central section 42 extends about 1 inch past the outermost non-pair bonding area 16 on each half of the strip 22. The bottom edge of each strip 22 is also notched inwardly in its end section adjacent each outside weld 32 (at each bottom corner). This results in a central section 46 descending below the level of the notched corner areas 48. The distance between the levels of section 46 and corner areas 48 is approximately equal to the predetermined distance between the height of the top central section 42 and upstanding section 44. In the preferred embodiment, this predetermined distance is about ½ inch. The length of the notch in the corner areas 48 is about 2½ inches, which is slightly longer than the tail 36, extending about 1½ inches inside of the outside weld 32. As seen in FIG. 4, the outside strip 24 has an unnotched uniformly even top edge but includes notches in its bottom corner areas 48 which are identical to the notches in corner areas 48 of inside strip 22. As shown in FIGS. 5 and 6, strips 26 and 28 are respectively identical to strips 22 and 24 except that (as mentioned previously) the bottom edges of strips 26 and 28 are unnotched and uniformly even over the length of each strip. After being welded together, the plastic strips 20 of the preferred embodiment of the invention tend to retain a linear shape. This allows the grid material 10 to be easily shipped, stored and handled until it is used to make a wall or other structure. The preferred method of constructing walls (as shown in FIG. 1) is to anchor guiding posts 18 into the ground at the corner positions where the wall is to be built. The base layer grid material 12 is next stretched out and the corner cells are slid down over the posts 18. Soil (such as sand or any other readily accessible and suitable fill material) is next filled into the cells 40 of the base layer grid material 12 and compacted (if desired). A grid layer 10 is then stretched out and slid down over the posts 18.

Figure 7:
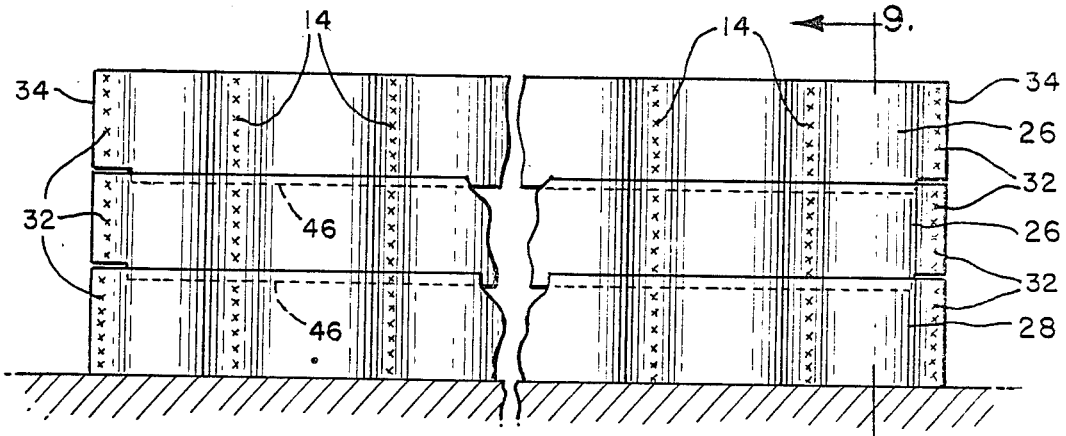
FIG. 7 is a side elevational view taken along line 7—7 of FIG. 1.
Figure 8:
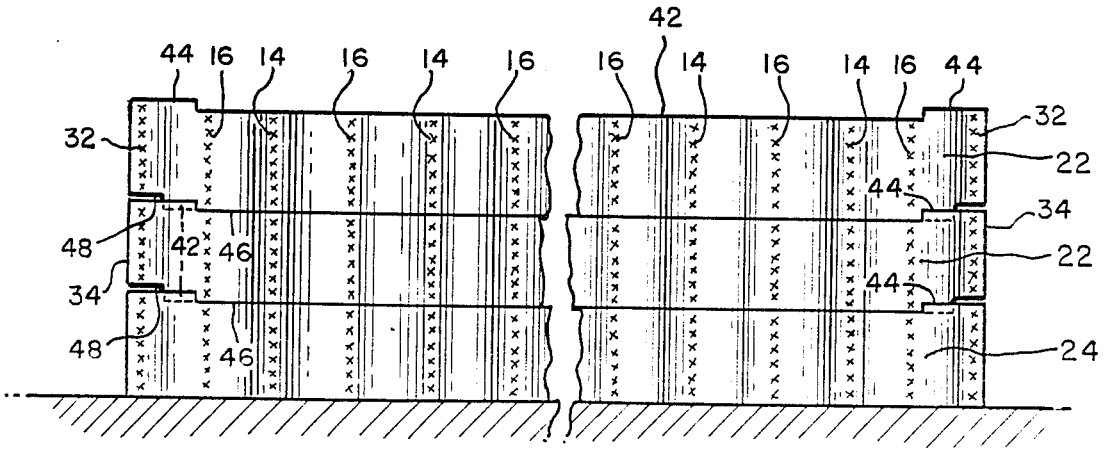
FIG. 8 is a sectional view (excluding the soil) taken along line 8—8 of FIG. 1.

In this position, and as shown in FIGS. 7 and 8, the notches in the bottom of this second layer and the notches in the top of the base layer cooperate so that in the central section of the grid, the cell wall material of the top layer rests on the cell wall material of the bottom layer. In these internal areas, alignment of the cells is not critical. On the perimeters of the grid, however, the downwardly extending central sections 46 of the strips 22 and 24 of grid layer 10 contact the top edge of outside strips 28 along its entire length, and the upstanding edge sections 44 of the inside strips 26 for a distance of about 4 inches. In order to get the second layer to nest properly, the flexible plastic of the strip must be slightly deformed so that the interfering areas become overlapping areas, the portions of cell wall material on the base layer 12 being outside the portions from the second layer of grid material 10. (See FIG. 9) Because of the notches in the bottom edges, the perimeter corners of perimeter cells cross over the upstanding sections 44 of the lower layer of grid material. After placement, the second layer is then filled with soil, and the process is repeated, stacking as many layers of grid material 10 as necessary to build the wall to desired height.

In the preferred embodiment of the invention, each plastic strip 20 is 8 inches wide. The grid materials may be manufactured to result in grids of any dimension, but are typically 3 to 8 feet wide and 8 to 20 feet in length when stretched out for use. The preferred plastic is sheet extruded polyethylene, 50 mil thick. Carbon black may be included to help prevent ultraviolet degradation of the grid material exposed to sunlight. The bonding may be accomplished by a number of methods known in the art. The preferred method of ultrasonic welding is accomplished using the process and apparatus disclosed in U.S. Pat. No. 4,647,325, issued Mar. 3, 1987 to Gary Bach and hereby incorporated by reference. The bond is formed by groups of welding tips simultaneously contacting the strips 20, the weld thus substantially traversing the entire width of the strips 20.

The design of the preferred embodiment provides two features which help to keep soil or other fill material in perimeter cells from escaping from stacked grid structures. First, the overlap on the cell walls on the perimeter of the grid is useful to align the cells during stacking. By nesting the walls of the top cells into the bottom cells, the perimeter cells are easily aligned and stay in alignment during the process of filling the cells with soil. Second, the overlap creates a barrier against soil particles leaking out between layers of aligned cell walls.

The invention provides a grid material which can be used to form walls using locally available fill, such as soil, in a simple, quick and unexpensive fashion, but which have minimal loss of soil material from the perimeter cell walls. This is especially useful in situations where very dry, find granular soil such as sand is used. With the present invention it is conceivable to build "sand houses" in desert terrain, like sod houses of early prairie pioneer days.

Of course it should be understood that a wide range of changes and modifications can be made to the preferred embodiment described above. For example, if overlapping and alignment is needed on only one surface of a wall, no distinct outside strips 24 and 28 would be needed. Likewise, no special base layer 12 is needed if the surface on which the wall is built is soft enough so that downwardly extending bottom edge sections 46 of strips 22 and 24 would sink into the soft surface. Further, instead of having notched inward central sections 42 on top of the strips 20 and downwardly extending central sections 46 on bottom, the two could be reversed. If the central section of strips 22 extended above the end sections, then the outside strips 24 and 28 would not need a notch in their bottom corners, but would need a notch in the bottom edge at each bonding area 14.

It is therefore intended that the foregoing detailed description be regarded as illustrative rather than limiting, and that it be understood that it is the following claims, including all equivalent, which are intended to define the scope of the invention.

We claim:

1. In a grid material for soil confinement comprising a plurality of plastic strips bonded together on their faces in a side by side relationship at bonding areas which are staggered from strip to strip such that the plurality of strips may be stretched in a direction perpendicular to the face of the strips to form a grid of cells, said strips forming cell walls, the improvement comprising:

said strips comprising two outside strips and one or more inside strips;

said inside strips having top and bottom edges which are notched such that identical grid materials stacked on top one another rest with portions of the cell walls on a perimeter of the grid overlapping each other.

2. The grid material of claim 1 wherein said outside strips have edges such that the cell walls formed by the outside strips overlap at each cell wall formed by said outside strips.

3. The grid material of claim 1 wherein:

said inside strips have a top edge with a central section which is notched inwardly and a bottom edge with end sections which are notched inwardly.

4. The grid material of claim 2 wherein:

said inside strips have a top edge with a central section which is notched inwardly and a bottom edge with end sections which are notched inwardly; and said outside strips have a top edge which is unnotched and a bottom edge with end sections which are notched inwardly.

5. The grid material of claim 4 wherein:

each strip includes two tail sections each of about 1 inch in length between an outside weld and the end of the strip;

the length of the section of plastic strip between bonding areas is approximately 6½ inches; and the notch on the top edges of said inside strips begins at about 5½ inches from both outside welds and the notches on the bottom edges of both said inside and outside strips extend about 1½ inches past the outside welds, resulting in said overlapping portions of said cell walls on a perimeter of the grid being approximately 4 inches in length.

6. The grid material of claim 5 wherein the strips are approximately 8 inches in width and both the notches on the top and bottom edges are approximately one-half inch in depth.

7. A base grid material to be used as the base of a stack of a plurality of grid materials, said base grid material comprising:

a plurality of plastic strips bonded together on their faces in a side by side relationship at bonding areas which are staggered from strip to strip such that the plurality of strips may be stretched in a direction perpendicular to the face of the strips to form a grid of cells, said strips forming cell walls;

said strips comprising two outside strips and one or more inside strips; and said inside strips having a notched top edge and an unnotched bottom edge such that the grid material of claim 1, when stacked on top of said base grid material, will rest with portions of the cell walls on a perimeter of the grid overlapping with portions of the cell walls on a perimeter of said base grid.

8. A stackable soil confinement grid material comprising:

repeating pattern of cell structures having thin cell walls in between cells and open cell tops and bottoms; and the cell wall material of the grid being notched such that the top edges of the cell wall material on the perimeter of a lower layer of grid material overlaps with the bottom edges of the cell wall material on the perimeter of an upper layer of grid material on top of said lower layer when the internal cell walls of said upper layer rest on top the internal cell walls of said lower layer.

9. The stackable grid material of claim 8 wherein the overlap comprises side by side cell wall material, the cell wall perimeter material of said lower grid fitting on the outside of the cell wall perimeter material of said upper grid.

10. The stackable grid material of claim 9 wherein the cell walls comprise long strips of flexible material bonded together, one strip to the next, at alternating and equally spaced bonding areas.

11. The stackable grid material of claim 10 wherein the strips are plastic and the bonding areas comprise ultrasonic welds substantially traversing the width of the strip.

12. The stackable grid material of claim 9 wherein the notches produce upstanding sections of cell walls on the perimeter of the top of said grid material, and the bottom of said grid material is notched inwardly at the perimeter corners of perimeter cells which cross over said upstanding sections of a lower layer of grid material.

13. A stackable grid for soil confinement comprising:

an even number of uniformly-wide, plastic strips in side by side relationship comprising a plurality of inside strips and two outside strips flanking the sides of the two outermost inside strips;

said strips ultrasonically welded together at alternating positions along said strips such that, the even numbers of strips being taken in pairs, each such pair of strips is welded together at outside welds adjacent the ends of the strips, leaving a short tail between the end of the strip and each said outside weld, and also being welded at bonding areas between said outside welds to create equal length segments between all welds; and one strip from each of two adjacent pairs also being welded together at non-pair bonding areas intermediate each of the welds in the pairs of strips;

the top edge of each inside strip having an inwardly notched central section of a predetermined distance below the height of the remaining unnotched, upstanding edge of the strip adjacent said outside weld;

the top edge of each outside strip being of uniform height; and the bottom edge of each strip having inwardly notched areas adjacent said outside welds, said bottom edge notches being of a depth approximately equal to said predetermined distance.

14. The stackable grid of claim 13 wherein the length of the bottom edge notch is slightly longer than the length of the tail, and the central notched section of the top edge extends just beyond the outermost non-pair bonding area.

15. The stackable grid of claim 13 wherein the strips comprise polyethylene.

16. The stackable grid of claim 13 wherein the strips are about 50 mil in thickness.

17. The stackable grid of claim 13 wherein the predetermined distance is about ½ inch.

18. The stackable grid of claim 13 wherein said strips are about 8 inches thick and wherein said equal length segments between welds each measure about 13 inches.

19. The stackable grid of claim 18 wherein said bottom notches extend about 1½ inches inside of the outside welds, and said central notched section extends about 1 inch beyond said outermost non-pair bonding area.

* * * * *

UNITED STATES PATENT AND TRADEMARK OFFICE

CERTIFICATE OF CORRECTION

PATENT NO. : 4,778,309

DATED : October 18, 1988

INVENTOR(S) : Gary Bach et al.

It is certified that error appears in the above-identified patent and that said Letters Patent is hereby corrected as shown below:

IN THE BACKGROUND OF THE INVENTION

In column 1, line 24, please delete "shapped" and substitute therefor --shaped--.

IN THE DETAILED DESCRIPTION OF THE DRAWINGS AND PREFERRED EMBODIMENT OF THE INVENTION

In column 2, line 40, please delete "heir" and substitute therefor --their--.

In column 3, between lines 36 and 37, start a new paragraph beginning with the second occurrence of "The".

In column 3, line 49, start a new paragraph beginning with "As".

In column 3, between lines 57 and 58, start a new paragraph beginning with "After".

UNITED STATES PATENT AND TRADEMARK OFFICE

CERTIFICATE OF CORRECTION

PATENT NO. : 4,778,309

DATED : October 18, 1988

INVENTOR(S) : Gary Bach et al.

It is certified that error appears in the above-identified patent and that said Letters Patent is hereby corrected as shown below:

In column 4, line 59, please delete "find" and substitute therefor --fine--.

In column 5, line 15, please delete "equivalent" and substitute therefor -- equivalents--.

Signed and Sealed this

Fourth Day of June, 1991

*Attest:*

HARRY F. MANBECK, JR.

*Attesting Officer*

*Commissioner of Patents and Trademarks*